US009437061B2

(12) United States Patent
Mehl et al.

(10) Patent No.: US 9,437,061 B2
(45) Date of Patent: Sep. 6, 2016

(54) ARRANGEMENT FOR THE AUTHORISED ACCESS OF AT LEAST ONE STRUCTURAL ELEMENT LOCATED IN A BUILDING

(71) Applicants: Bernhard Mehl, München (DE); Maximilian Schütz, Gmund (DE); Carl Edouard Pfeiffer, München (DE)

(72) Inventors: Bernhard Mehl, München (DE); Maximilian Schütz, Gmund (DE); Carl Edouard Pfeiffer, München (DE)

( * ) Notice: Subject to any disclaimer, the term of this patent is extended or adjusted under 35 U.S.C. 154(b) by 0 days.

(21) Appl. No.: 14/767,962

(22) PCT Filed: Feb. 13, 2014

(86) PCT No.: PCT/EP2014/052827

§ 371 (c)(1),
(2) Date: Aug. 14, 2015

(87) PCT Pub. No.: WO2014/125028

PCT Pub. Date: Aug. 21, 2014

(65) Prior Publication Data

US 2016/0005247 A1 Jan. 7, 2016

(30) Foreign Application Priority Data

Feb. 15, 2013 (DE) ..... 10 2013 002 669

(51) Int. Cl.
*G07C 9/00* (2006.01)

(52) U.S. Cl.
CPC ..... *G07C 9/00103* (2013.01); *G07C 9/00111* (2013.01)

(58) Field of Classification Search
CPC ..... G07C 9/00309; G07C 9/00007; G07C 2009/00769; G07C 9/00111; G07C 9/00571; G07C 9/00103; G07C 2009/00793
USPC ..... 340/5.61
See application file for complete search history.

(56) References Cited

U.S. PATENT DOCUMENTS 7,170,407 B2 * 1/2007 Wagner ..... G08B 13/2462 340/10.1
7,373,352 B2 * 5/2008 Roatis ..... G06F 21/6209

(Continued)

FOREIGN PATENT DOCUMENTS

DE 10 2005 057101 6/2007 ..... G07C 9/00
WO WO 2005/066908 7/2005 ..... G07C 1/10

OTHER PUBLICATIONS

The Notification Concerning Transmittal of International Preliminary Report on Patentability (Chapter I of the Patent Cooperation Treaty), in English, dated Aug. 27, 2015, the International Preliminary Report on Patentability with the Written Opinion of the International Searching Authority, in English, dated Aug. 18, 2015, and the International Search Report, in English, dated Jun. 12, 2014, which were issued by the International Bureau of WIPO for Applicants' corresponding PCT application having Serial No. PCT/EP2014/052827, filed on Feb. 13, 2014.

*Primary Examiner* — Mark Blouin
(74) *Attorney, Agent, or Firm* — KISI Incorporated

(57) ABSTRACT

The invention relates to an arrangement and a method for the authorized access of at least one structural element located in a building. The arrangement comprises a remote server which is arranged in a long-range network and allocates and stores a personalized access authorization, in connection, via a first bidirectional communications channel, with a control unit located in the building and used to control said at least one structural element, a terminal which is allocated to a user, registered at the server and connected to said server via a second bidirectional communications channel, and a positioning and identification system for said terminal, which is located in the building and/or global and in communicative connection with the control unit and/or terminal.

11 Claims, 8 Drawing Sheets

(56) References Cited

U.S. PATENT DOCUMENTS 8,638,202 B2 * 1/2014 Oesterling ..... G07C 9/00309 307/10.3
8,736,418 B2 5/2014 Bozionek et al. ..... 340/5.2
8,836,475 B2 * 9/2014 Donlan ..... G07C 5/008 235/383
2004/0243812 A1 12/2004 Yui et al. ..... 713/182
2004/0246097 A1 * 12/2004 Queenan ..... G07C 9/00103 340/5.61
2007/0200665 A1 8/2007 Studerus ..... 340/5.61
2012/0280783 A1 11/2012 Gerhardt et al. ..... 340/5.6
2016/0035163 A1 * 2/2016 Conrad ..... G07C 9/00309 340/5.61

* cited by examiner

ARRANGEMENT FOR THE AUTHORISED ACCESS OF AT LEAST ONE STRUCTURAL ELEMENT LOCATED IN A BUILDING

The invention relates to an arrangement for the authorised access of at least one structural element located in a building according to claim 1 and a method for the authorised access of the at least one structural element according to the preamble of claim 10.

The invention is to be used in the area of building management services within the scope of remote maintenance of building services installations, as well as for building security. A further important field of application is represented by the locking technology connected to the building and access control for the building.

In the latter field of application, it is a frequent problem in the administration of buildings and real estate that the transfer of access rights can only occur in a laborious and often extremely cumbersome manner with currently available technologies. The most frequent case of the transfer of access rights to a building consists in handing over a mechanical key which is designed to match a lock situated on or in the building. By handing over such a key, damage can occur by losing the key, reproducing illegal copies, wear and tear of the key or its misuse.

In addition to handing over a key, other types of access control are also currently in use. All of these access control systems have a common negative aspect: they require in each case the handover of a physical data carrier to the authorised person. In addition to the aforementioned form of a mechanically encoded key, more modern types are in use in which the data carrier is arranged in form of magnetic or chip cards. The latter cards offer the advantage over the mechanical key that a card once handed over can also be blocked again and can also be limited with respect to its use in regard of time and location. As a result, an electronic data carrier represents an increase in security over a mechanical data carrier.

Many locks have a specific owner but changing users. Under this condition, physical data carriers in form of keys lead to disadvantages in numerous applications. Consequently, physical handover of a key must also occur in the case of private short-term rental, even if the duration of the rental is arbitrarily short. Buildings and real estate are a further example for the background of such a case, for the upkeep of which a large number of service providers are required. In such a case, all service providers who provide a service to the real estate or property of the user or lead to such a service must be granted access, and must therefore be provided with a physical key in some form. This relates especially to cleaning personnel, various delivery services, babysitters, nursing personnel, emergency services and similar service providers.

In addition to the physical data carriers, there is obviously also the possibility to provide passwords and PINs in particular. Persons with authorised access enter said PIN into a respective apparatus on the building. The assignment of the PIN or the password thus represents a so-called code lock. Said code lock can certainly be transferred in a wireless manner without a physical data carrier and be provided to the authorised person. However, a pure code lock for achieving an adequate security level is mostly insufficient for nearly all applications. The PIN or the password can be forgotten or be given away. For security reasons, the PIN or the passwords are nearly always combined with a physical data carrier such as in the case of cash cards. The advantage of the wireless transfer capability of the PIN is thus strongly reduced or even made void.

If efforts are made to solve the aforementioned problems by using electronic access systems, improvements with respect to the administration capability of rights management are certainly achieved. The requirements concerning the building and investments rise considerably for the builder however, especially in the case that the renovation of existing or even historic building structures is concerned. It may not be possible to install electronic access control in listed buildings for reasons concerning building regulations alone. It is especially difficult for tenants of an apartment to install an adequate solution for their rooms themselves because such installations would nearly always require the agreement of the other tenants and the building owner.

A further problem is the logging of the use of the key after its handover. It requires a highly complex arrangement to determine which user has actually unlocked a specific door at a given time and whether user has then actually truly opened the door. Such logs are therefore mostly not part of a standard solution, although such information would offer relevant advantages especially in insurance cases.

Especially in the case of larger properties with several access points, as occurs in large cities for example, the problem is compounded that often no modifications are possible on the front door of such properties (e.g. a multi-storey house) for legal reasons. Modifications can be made however to individual apartment doors within the building. This means that the access process in its entirety is not clear. In order to cover the entire access process, the system would have to cover both cases of use.

The statements made with respect to locking devices or devices for access control also apply analogously to other devices within the buildings, especially devices of building installations which require regular maintenance and checking such as ventilation and heating systems, elevator motors or gas and water installations. Remote maintenance apparatuses are provided for such areas for example which can only be accessed by specific circles of persons and for which regular maintenance and checking cycles should be verifiable. Finally, such devices can also be controlled remotely, wherein remote control should also only occur by authorised personnel. The problem also arises in this case concerning an access key and its monitoring and administration, wherein analogously entirely similar problems occur as in the case of the aforementioned locking and securing systems.

Locking systems are known from the prior art in which partly web-based solutions are used.

The US published patent application US 2004/0243812 A1 describes an arrangement for an access system that can be used by several persons, in which an access control system is provided within the building which stores user and access data. The respective users are provided with identification means such as a chip card in particular, and identify themselves by means of the identification means at the access control system. Depending on the respectively present authorisation status, the user is granted access to the building or it is denied to the user. Such an arrangement corresponds fully to the described grant of a key-like access means with the additional advantage that the user can be identified unequivocably and specific authorisations can be granted in a personalised manner. A management server is used according to the specification for the administration of this arrangement, via which the arrangement can be configured. The problems in connection with the assignment of a key can only be eliminated in part with such an arrangement since the assignment of an identification means remains necessary in any case.

The US published patent application US 2012/0280783 describes an arrangement and a method in which the assignment of a corporeal identification means is avoided and in which a virtual key is applied. The aforementioned method is carried out via a communications network between a user terminal, a web server and locking components arranged in the building. It occurs in such a way that the terminal is triggered by a starting pulse to connect to the web server. The web server checks the authorisation of a user assigned to the terminal. In the case of a positive result of this checking process, the web server activates the locking components arranged in the building and sends a respective message to the terminal. The start pulse can be a QR code arranged on the building, an RFID transmitter or any other means for near-field communication, as well as a location determined via a navigation system.

Although the problems in connection with the assignment of a physical key no longer occur in the aforementioned method, the method is still disadvantageous in other aspects. A first disadvantage consists in the considerable amount of communications. For a locking process it is necessary to always build up in this procedure a communications channel via a long-range network between the terminal of the user and the web server as well as between the web server and the locking components in the building. This leads to a susceptibility to malfunctions of the entire procedure which cannot be neglected on the one hand and a high load on the communication network on the other hand. This is especially problematic when a large number of users is granted access authorisation for a given lock. Furthermore, there is a possibility that especially the initial connection build-up of the authentication between the terminal and the web server is manipulated by attacks, so that unauthorised persons gain access.

It is thus the object of the invention to provide an arrangement for the authorised access of at least one structural element located in a building with which the aforementioned disadvantages are eliminated or can be avoided. In particular, the communication occurring on the long-range networks shall be minimised to a minimum amount and the authentication on the web server shall occur completely outside the sphere of action of the user and cannot be influenced by the same and shall be more difficult to attack from the outside.

This object is achieved by an arrangement for the authorised access of at least one structural element located in a building according to the features of claim 1 and by a method with the features of claim 10. The dependent claims contain appropriate and advantageous further developments and embodiments.

The arrangement for the authorised access of at least one structural element located in a building contains a remote server which is arranged in a long-range network for the assignment and storage of personal access authorisation in connection, via a bidirectional communications channel, with a control unit located in the building for the at least one structural element and a position determination and identification system for a terminal. As a result of location determination of the terminal via a bidirectional communications channel which occurs through the position determination and identification system, a query occurring by the position determination and identification system can be made to the server for the access authorisation which is stored there and linked to the terminal. An actuating action of the at least one structural element can further be carried out by the control unit as a consequence.

It is the fundamental concept of the arrangement in accordance with the invention to simultaneously check two aspects of authorised access and to have said aspects carried out by the arrangement without requiring a data carrier handed over to the user as a key. A first aspect is the test for an existing access authorisation. This occurs via a bidirectional communications connection between the server and the position determination and identification system, thus outside of the range of the user. The access authorisation per se lies on the remote server and is firstly protected there from unauthorised access and can secondly be administrated in a simple way. Thirdly, the communications process of the actual authentication also occurs without any involvement of the terminal.

A second aspect is a localisation of the location where the terminal is situated, i.e. especially the location of the person who carries the terminal. As a result of these combined aspects, it can be determined by the arrangement whether the person is directly precisely close to the access for which access is requested, or is in a determined vicinity thereto; said person is identified and only if the remote server has verified the access authorisation will access be granted or a respective action of the structural element will occur.

The arrangement is therefore formed in such a way that as a result of a determination of the location of the terminal which has occurred by the position determination and identification system, a query can be made via the control unit and via the first bidirectional communications channel to the server for the access authorisation which is stored there and linked to the terminal, and as a result of this query by the control unit an actuating action of the at least one structural element can be realised.

For the purpose of identifying the triggering of further structural elements, the previous authorised and identified triggering of a structural element can be used if it is temporally and/or locally dependent.

The arrangement therefore determines at first where the user is located and which user is concerned. The service then queries whether the thus identified user has access authorisation. As a result of this query, the structural element is actuated accordingly.

The arrangement is formed in such a way in a further embodiment that as a result of an identifying detection of the location of the terminal which occurs by the position determination and identification system and a query that can be carried out by the terminal via a second bidirectional communications channel to the server a control signal can be output by the server to the control unit, wherein as a result of said control signal an actuating action of the at least one structural element can be carried out by the control unit.

In this embodiment, the arrangement is formed in such a way that a query is made to the server by the terminal, whereas simultaneously the location of the terminal is determined. Once access authorisation has been checked on the server, it emits a control signal to the control unit. If the location of the terminal is also correct, an actuating action of the at least one structural element will now occur. In this embodiment, the query for the access authorisation to the server does not originate from the control unit but from the terminal.

In a further embodiment, the arrangement is formed in such a way that the terminal is provided with information about the position determination and identification system and communicates with the query for accessing the structural element via the second bidirectional communications channel to the server, so that in one step the access authorisation and localisation can be checked, and after the completed check an actuating action of the at least one structural element can consequently be carried out by the control unit.

The first and the second communications channel can principally be selected arbitrarily and are technically not determined. In one embodiment of the arrangement, the first and/or second bidirectional communications channel can be selected automatically or utilised in combination on the basis of current availability, precision and/or current cost factor in order to ensure more precise detection.

In a further embodiment, the respective access authorisation stored on the server for each terminal comprises defined positional data which are unequivocably assigned to the respective terminal, wherein a spatially precisely defined access area can be determined by the positional data.

This embodiment not only allows the assignment of access authorisations to individual identities and terminals, but also to link said identity in addition to a precisely defined location. It is thus possible to achieve access to the structural element even from a remote location, but under the condition that said location is precisely localised. Such an arrangement thus realises "hot spots" to a certain extent, from which specific actions can be carried out, whereas such actions are excluded in the structural element from other locations even in the case of correct identity of the user otherwise.

In one embodiment, the position determination and identification system is formed as a triangulation system with at least two signal strength detectors for the identification system originating from the terminal.

In another embodiment, the position determination and identification system is formed as a triangulation system with at least two signal transmitters and the terminal as a signal strength detector of the incoming identification signals.

In another embodiment, the position determination and identification system detects a position signal emitted by the terminal, which is refined in addition by at least one signal of a signal transmitter detected by the terminal.

Such a position determination and identification system does not require any bearing signals, but it determines the distance via the signal strength of the terminal and/or the signal transmitter. The location of the terminal can then be determined precisely via subsequent triangulation. It is advantageous in this case that the normal communications signal of the terminal can be used, but also several additional communications signals. Such triangulation arrangements are especially advantageous for configurations close to or within a building.

The signal strength detectors are respectively formed in one development as a near-field sensor and/or a motion detector.

The signal transmitters are respectively formed in one development as a local wireless transmitter.

In addition, the position determination and identification system can comprise a local wireless transmitter for signal exchange with the terminal in one development, wherein the data transmitted by the signal exchange are provided for data synchronisation with the access data stored on the server.

The position determination and identification system is thus not only used for position determination, but also carries out communicative data exchange with the terminal.

In an appropriate embodiment, the position determination and identification system can be activated through a message originating from the terminal, utilisation documentation of the terminal and/or a change in the access authorisation.

In such a development, the position determination and identification system need not remain permanently activated, but is mostly in a passive state.

In one embodiment, the control unit is formed as a virtual opener that can be operated remotely, wherein the at least one structural element can be realised as at least one locking, closing and/or securing device which can be actuated by the control unit.

In this embodiment, the arrangement is specifically used as a closing device which controls access from and to a building and limits said access with effective security.

In one embodiment, the virtual opener accesses an in-house control installation and switches the locking, closing and/or securing device via the control installation. The virtual opener practically acts in this case as a switching element which is connected to the existing devices of the control installation and switches said devices.

As regards the method, a query is made to the server for the access authorisation stored there and linked to the terminal for the purpose of authorised access to at least one structural element situated the building as a result of an identifying location determination of the terminal by the control unit which is carried out via the first bidirectional communications channel by the position determination and identification system. As a result of this query by the control unit, an actuating action of the at least one structural element is carried out.

The method for the authorised access of the at least one structural element situated in a building can also be implemented in such a way that as a result of an identifying location determination of the terminal which has occurred by the position determination and identification system and a query by the terminal via the second bidirectional communications channel to the server a control signal is output by the server to the control unit and, as a result of this control signal, an actuating action of the at least one structural element is carried out by the control unit.

The arrangement in accordance with the invention will be explained below in closer detail by reference to embodiments. As described above, the arrangement in accordance with the invention is based on the concept that access rights are not transmitted by means of code lock and/or a physical data carrier, but are assigned as an encrypted data record between a central local server and several geographically distributed mobile systems. The connections can especially be wireless. The mobile systems are the hardware platforms of the users, i.e. a smart phone or a tablet PC for example, in an advantageous further development of the invention.

One advantage of the present invention is the configuration of the system. It is independent of the respectively used infrastructure in the respective building or on the part of the authorised persons. The arrangement is rather formed in such a way that it can be operated on the basis of an arbitrary combination of already existing or newly purchased hardware. As a result, the encroachment in the existing building structure is minimised and the costs for the installation of the system components are reduced at the same time. Different types of infrastructures, apparatuses and structural elements which may already exist can be accessed advantageously by means of the same system. This relates especially to various access control techniques and apparatuses for in-house and building communications.

A further aspect of the arrangement in accordance with the invention is the realisation of a quasi-virtual transfer of rights between an administrator on the one hand and one or several users on the other hand. Administrative levels can be introduced above, between or beneath these parties in order to enable an authorisation of a limited number of virtual rights to the residents of the building for self-administration. It is now possible with these means to provide access to the building or general access to structural elements present in the building, or to grant authorisations for this purpose and to carry out the necessary steps, wherein the assignment of the access rights can occur independently of the localisation or local vicinity of the door to be opened for example. As a result, the opening of the street door can occur via an apparatus situated in an apartment or in a control room, so that no structural changes are necessary in the building per se, at least in the area of the building that is used communally. This apparatus forms a virtual door opener in its entirety and with respect to its function. Said virtual door opener is especially important in order to produce unlocking or opening of the door even outside of the range of local wireless technologies.

Furthermore, the devices in accordance with the invention which are present in the apartment or in the control room of the system participant, optionally in combination with other existing transmission/receiving devices, especially a router, Bluetooth transmitter, NFC tags or different repeaters, are capable of localising the user and the rights owner both within and outside of the apartment by a measuring method with radio technology.

Said measuring method is especially a triangulation or a position-processing algorithm. The measuring method and the thus achieved localisation allow the automated documentation of the presence of an identified user, as well as his/her access to and length of stay in the respective object. The documentation of the presence can be coupled to successful unlocking for increasing security or reasons of convenience. As an alternative or in combination, a change in the authorisation can be carried out in automated manner after a specific recognised action by the user. The access authorisation can thus be withdrawn for example at a specific point in time. This would be similar to relinquishing the key. The entrance and exit can generally be locked automatically, which offers advantages in respect of insurance.

Further advantages and details of the invention are provided in the following embodiments of the subject matter of the invention which are described below and shown in the drawings. FIGS. 1 to 10 are used for illustration. The same reference numerals are used for the same or similarly acting parts, wherein:

Figure 1:
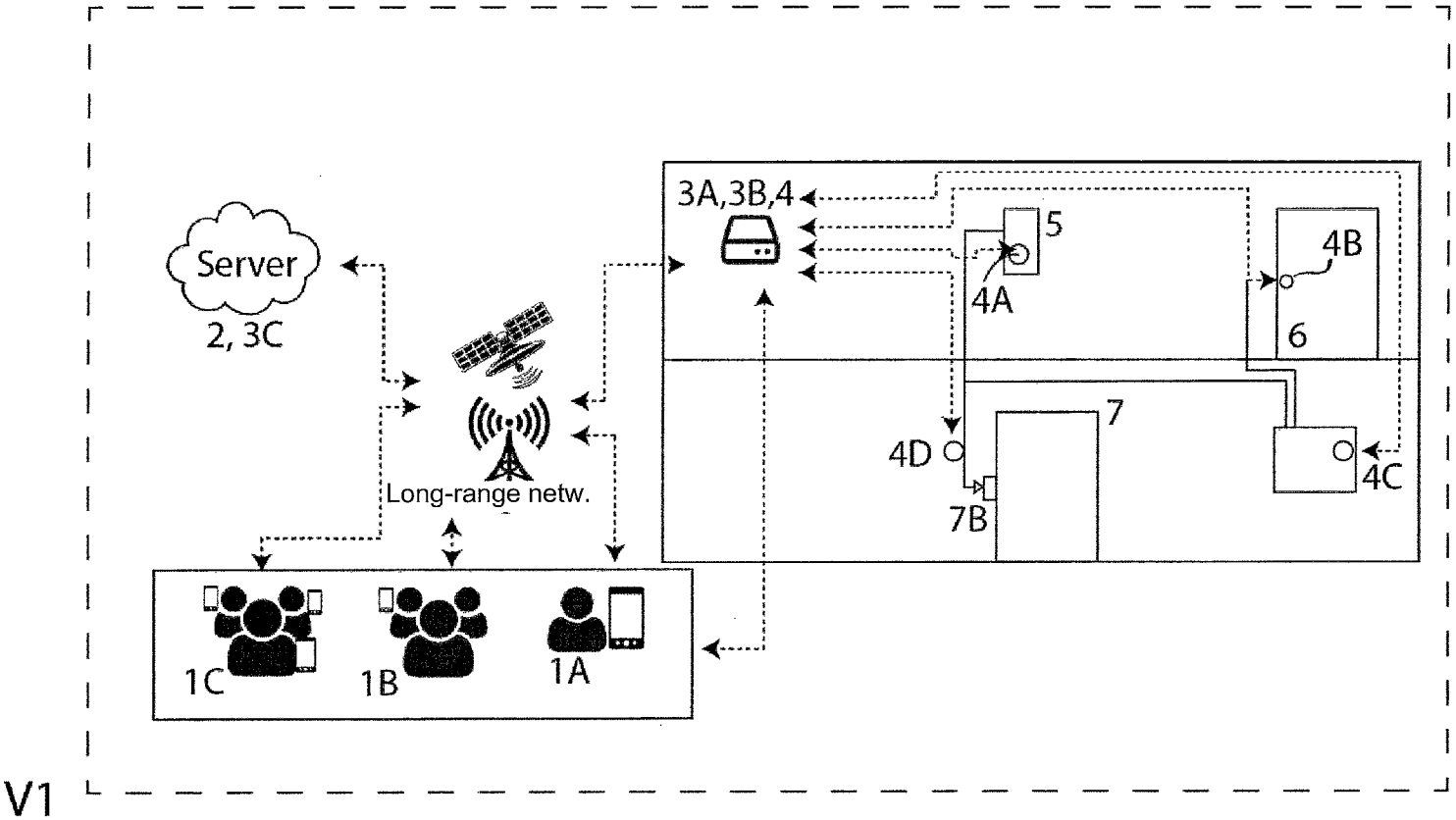
FIG. 1 shows a schematic block diagram of the apparatus in accordance with the invention.

FIG. 1 shows a schematic block diagram of the arrangement in accordance with the invention. The arrangement V1 for remote actuation of building-related structural elements comprises according to FIG. 1 an arbitrary number of geographically distributed personal terminals. The terminals are especially hardware platforms 1A and 1B. They respectively act as a signal transmitter 1 and communicate in a wireless or cable-bound manner with a server 2 over an arbitrary long-range network and a base station 3 present in the building, which base station is used as a position determination and identification system.

The method steps that can be carried out by this arrangement now occur in such a way that in a first step the location of the terminal is detected by the position determination and identification system 3 in form of a base station. The terminal is identified in this process. A query is made to the server by the position determination and identification system via a first bidirectional communications channel whether there is access authorisation for the building for the terminal, i.e. for the user, and whether the user has been registered in advance on the server.

The server sends a respective response via the bidirectional communications channel to the control unit. If the existence of access authorisation is confirmed by the server, one of the structural elements 5, 6 and/or 7 situated in the building is accessed by the control unit.

The terminal receives from the server via a second bidirectional communications channel a response on the performed closing process via the long-range network. This response occurs for example over a short messaging service such as via SMS. The communication between the server and the terminal is limited with respect to the closing process to pure information on its successful or omitted performance. Such communication can principally also be dispensed with, so that bidirectional communication between the terminal and the server is not required at all for the closing process.

In the case of such a configuration, the bidirectional communication between the server and the terminal is only used for registration processes of the user or for updating the user data stored on the server.

It is principally additionally possible that bidirectional data transmission also occurs between several personal terminals. An access authorisation assigned to the terminal 1A can especially also be transferred from the terminal 1A to the terminal 1B, so that the signal transmitter 1B is now also authorised for remote actuation of the structural element, i.e. especially for access to the building, and is thus made into a carrier for access authorisation. In order to simplify administration, further administrative levels can be produced so that the terminal 1B can also authorise new terminals 1C with the authorisation of 1A.

Such a transfer of authorisations and access authorisations is appropriately logged in advance on the server together with a unique identification of the terminal, and can especially be made for a period of time that is determined in advance and thus temporarily. In such a case, the position determination and identification system 3 queries the server during the access attempt of the user whether such an allocation of access rights is authorised.

Once the thus defined validity period expires, the user of the terminal 1A withdraws the authorisation or the terminal 1B cancels the authorisation automatically within the scope of a checkout procedure, which will also be logged on the server. The server is therefore the relevant platform for the administration of all access rights from the signal transmitters to the structural elements within the building.

The terminals 1A, 1B and 1C, as well as the position determination and identification system and the control units, can all be devices which can communicate in the long-range network. Embodiments are therefore possible in form of stationary personal computers, portable computers, especially laptops or notebooks, tablet PCs, smartphones, other mobile phones or digital computing machines. The access to the long-range network is especially arranged as internet access. It occurs via a random interface and the resulting standards such as GPRS, EDGE, UMTS, WLAN, WiMAX, femtocells, satellite access and/or a phone link. The query is transferred via data, message or voice link from the signal transmitter 1 to the server 2. In the case of a voice link, the server 2 comprises means for operating voice-controlled menu interfaces with word and/or voice recognition.

Access rights for buildings can be granted and revoked administratively via the server 2. Furthermore, these access rights are managed locally and temporally, and access controls can be performed. The administration of the access rights stored on the server occurs either at the location of the server itself, from a fixed localised administration device, or also in a remote-controlled manner by one of the terminals, which acts in such a case as a master terminal. The access rights can therefore be administrated, approved or revoked for example by central key security services in a head office or by their field representatives.

An operation of the arrangement is obviously also possible in which a query of the user is performed via the terminal to the server. If the server authorises the access by the user, it now outputs a respective signal to the access system of the building. The query does not occur in this case by the position determination and identification system in the building, but by the terminal of the user itself. The query is transmitted via data, messaging or voice connection from the terminal to the server 2. In the case of a voice connection, the server 2 comprises means for operating voice-controlled menu navigation with word and/or voice recognition.

In order to ensure that the server 2 can produce access for a user of one of the terminals to the building, the usage rights of the user of the signal transmitter concerning the queried building are checked on the server in response to the query to the server. An authentication of the user thus also occurs, which is immediately followed by checking the authorisation for the access system of the respective building granted to this user.

If the user is not successfully authenticated, a notification message can be sent to the administrator of the queried building, so that said administrator can decide whether or not he or she wishes to carry out a spontaneous remote opening or transfer of rights.

If the user is successfully authenticated and the authorisation of the user is confirmed, the current location of the user and his/her local presence, i.e. his/her terminal and signal transmitter, can be checked in a second step with respect to the queried building. This occurs via the proof of the presence of the terminal 1 in the communication network of the respective building by the position determination and identification system or after synchronisation of the GPS position relative to the respective building and/or after the recognition of the terminal by a receiving and/or transmitting unit. With such an additional development, the actual presence of the user before the building can be forced for example, so that said user is granted access and does not perform access to the building in form of "remote control". Furthermore, the access locations to the structural elements present in the building can thus be determined in a spatially unequivocal manner, so that maintenance services situated at precisely defined locations are granted access to structural elements in a specific building. Finally, such a development also allows precise tracking of a user and determining his/her location in a security-relevant area.

A base station 3 is provided within the building, which base station also carries out bidirectional data exchange via the long-range network with the server. The base station is formed by a router for example. The base station 3 receives acceptance information from the server following successful authentication of a user and initiates closing and opening processes within the building. Furthermore, several positioning systems 3A and 3B can be present, which are then used for determining the location of the user, i.e. his/her terminal, which will be explained below in closer detail.

The base station is coupled to one or several control units, which in the present example are formed as a control unit 4A, 4B, 4C and 4D. The control units 4A, 4B, 4C and 4D respectively access existing building installations such as intercom and control systems 5, a central control unit, closing relays conventionally used in such systems, door buzzers 7B on a door 7, or a closing mechanism 6 directly.

The control units are able to not only access the closing technologies. Other systems within the building can be considered as building installations such as ventilation and heating systems, and systems for power or water supply which require regular maintenance and checking by qualified staff. It can thus be ensured for example that specific actuating elements, switches and valves can only be operated precisely by persons who are authorised for this purpose.

Changes in the closing state of the building or the actuation of the existing building installations is carried out from the server 2. Depending on the type of the signal transmitted by the server to the base station, the following procedures can be provided:

There is an implementation of the server signal within the respective base station and a signal transmission from one of the base stations 3A or 3B to the control units, especially the control units 4A, 4B, 4C and 4D. The control units actuate the building installations, in this case the intercom and locking system 5. In the example illustrated here, signal transmission occurs from the router 3A to the control unit 4B, and from there to the locking technology 6. The signal transmitted by the server can be encrypted. In such a case, the encrypted signal is decoded by the respective control unit 4A, 4B, 4C and 4D and the required action is carried out.

Figure 2:
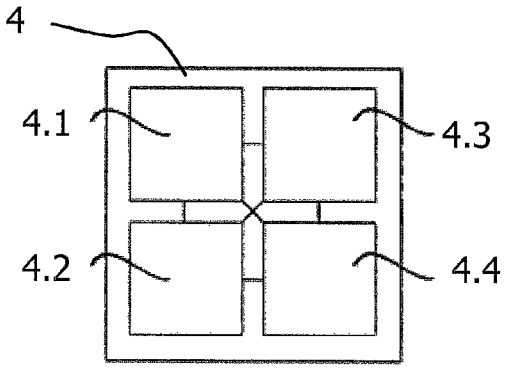
FIG. 2 shows a schematic block diagram of a virtual opener.

FIG. 2 shows an exemplary embodiment of a control unit in form of an abstract illustration. The control unit has bidirectional communication with the server in this case and access to locking technology. The control unit 4 contains a transmitting/receiving module 4.1 for the bidirectional communication with the server and the individual hardware platform or terminal of the user. Furthermore, power supply 4.2 with a transformer is provided. The control unit can comprise a processor 4.3 with a respective processing unit for converting the signals received from the server and the terminal into control signals for the structural elements to be influenced within the building, i.e. especially for the locking devices. The control unit further contains one or several connections 4.4 for coupling to the structural element to be influenced, especially for coupling the control unit to the components of the locking system.

The control unit can access already predetermined building installations in different ways. The control unit 4A can transmit the signal in different ways from an intercom and locking system 5 to the building installations.

Figure 3:
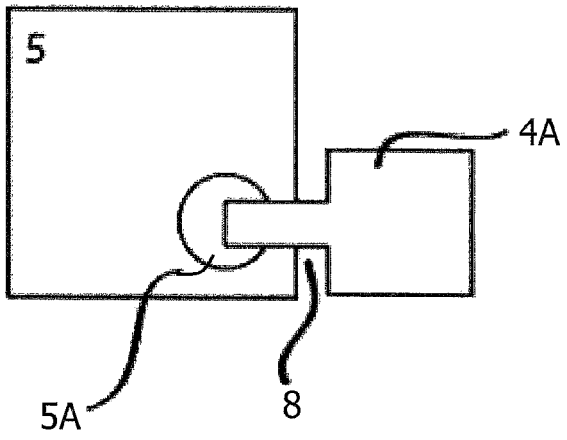
FIG. 3 shows a schematic block diagram of a first variant of the control unit as a virtual door opener.

FIG. 3 shows a schematic block diagram in this respect for the arrangement of the control unit 4A, in which the signal of the control unit is transferred via a push button fixed to the door opening button. An intercom and locking system 5 is provided in this example, i.e. especially an in-house phone with a buzzer for the remote-controlled opening and locking of a door. It contains a door opening button 5A, via which the locking of a door is usually manually released. In the present example, the control unit 4A is arranged directly adjacent to the intercom system. The control unit comprises a latch 8 which acts as an actuator on the door opening button. Once the user has been authenticated and the server has transmitted a respective signal to the control unit, the latch 8 is made to move. It acts on the door opening button, as a result of which the closing mechanism of the respective door is unlocked by the intercom and locking system.

Figure 4A:
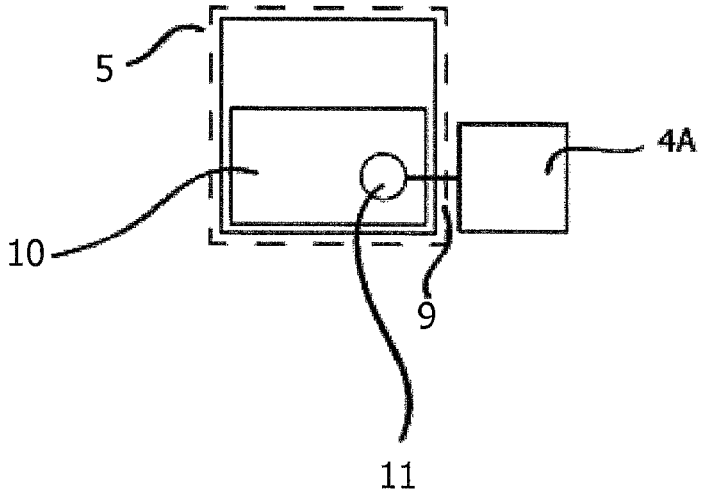
FIG. 4A shows a schematic block diagram of a second variant of the control unit.
Figure 4B:
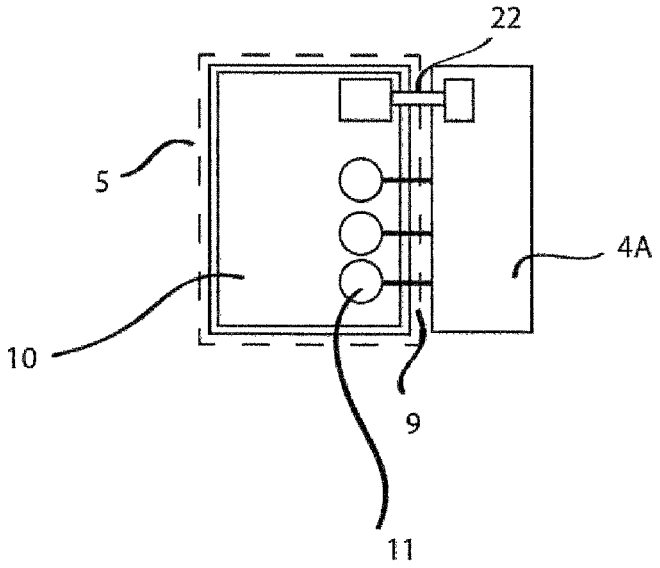
FIG. 4B shows a schematic block diagram of a third variant of the control unit.

FIGS. 4A and 4B show schematic block diagrams of the attachment of the control unit 4A, which triggers the switching module of an existing intercom and locking system 5.

FIG. 4A shows a schematic block diagram of a second variant of the control unit. A control unit 4A and the intercom and locking system 5 are provided in the illustrated example. It contains a circuit board 10 with a switching module 11 arranged thereon, e.g. a relay. The switching module is in connection via a connecting cable 9 with the control unit 4A. In the case of a successful authentication of the user by the server and transmission of a respective signal to the control unit, a respective control pulse is output via the connecting cable 9 to the switching module 11, by means of which the locking mechanism is unlocked.

FIG. 4B shows a schematic block diagram of a third variant of the control unit. In this embodiment, several switching modules 11 are provided on the circuit board 10 of the intercom and locking system 5. They respectively switch separate and mutually different locking mechanisms on different doors and other access points, or are used for example for producing a voice connection. The locking system thus acts as a central locking device for the building. In the case of respective authorisation signals from the server to the control unit 4, signals are sent via the connecting cable 9 to the matching switching modules 11 on the circuit board 10 of the intercom system 5. As a result, individual authorised access points to the building are thus selectively released, in that the respective locking mechanisms are switched. The access to the switching modules can also occur in an automatically coupled manner, thus producing an advantage when a voice connection needs to be established first before the door can be opened.

A data connection 22 can be used as an additional communications channel, via which signals can be transferred from the system to the server. This can especially be used for the harmonised tracking of the used access methods because in this case all activities are visible in a system.

Figure 5:
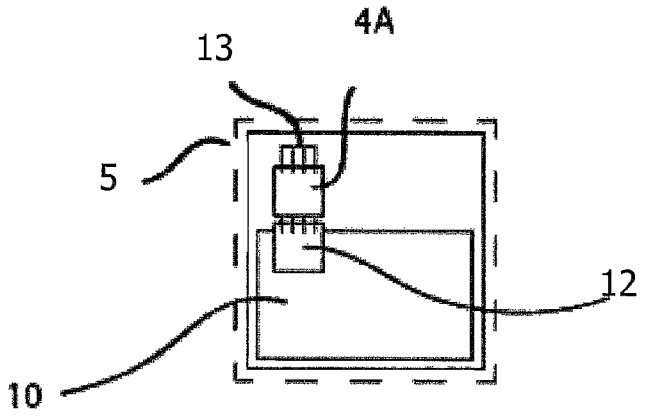
FIG. 5 shows a schematic block diagram of a fourth variant of the control unit.

FIG. 5 shows a schematic block diagram of a fourth variant of the control unit. The control unit is directly connected to the feed lines of the intercom and locking system 5. It thus transmits signals and receives power at the same time. It is also possible to transmit signals from the control unit back to the base station 3. This is used especially for confirming operational states such as the battery charging or opening states or incoming buzzing signals.

In this embodiment, the control unit 4A forms an integral component of the intercom and locking system 5 and is thus structurally joined thereto. The entire arrangement thus externally represents a respectively improved variant of an intercom and locking system of the building which is equipped for access via a long-range network. The components of the control unit 4 and the circuit board 10 are situated within the common housing. The components of the control unit 4 and the circuit board 10 are coupled to each other via an internal adapter plug connection 12. The entire arrangement comprises a feed line 13, via which access to the building installations occurs on the one hand, and the intercom and locking system is linked to the long-range network on the other hand.

A fifth variant of the control unit is also possible, wherein in this case data transmission is enabled in addition to the regular arrangement shown for example in FIG. 4B, so that electronic opening queries not transmitted via the control unit can be transferred to the server for documentation purposes. This is especially used when an already existing locking card system is used and the control unit is added as a further opening method.

Figure 6:
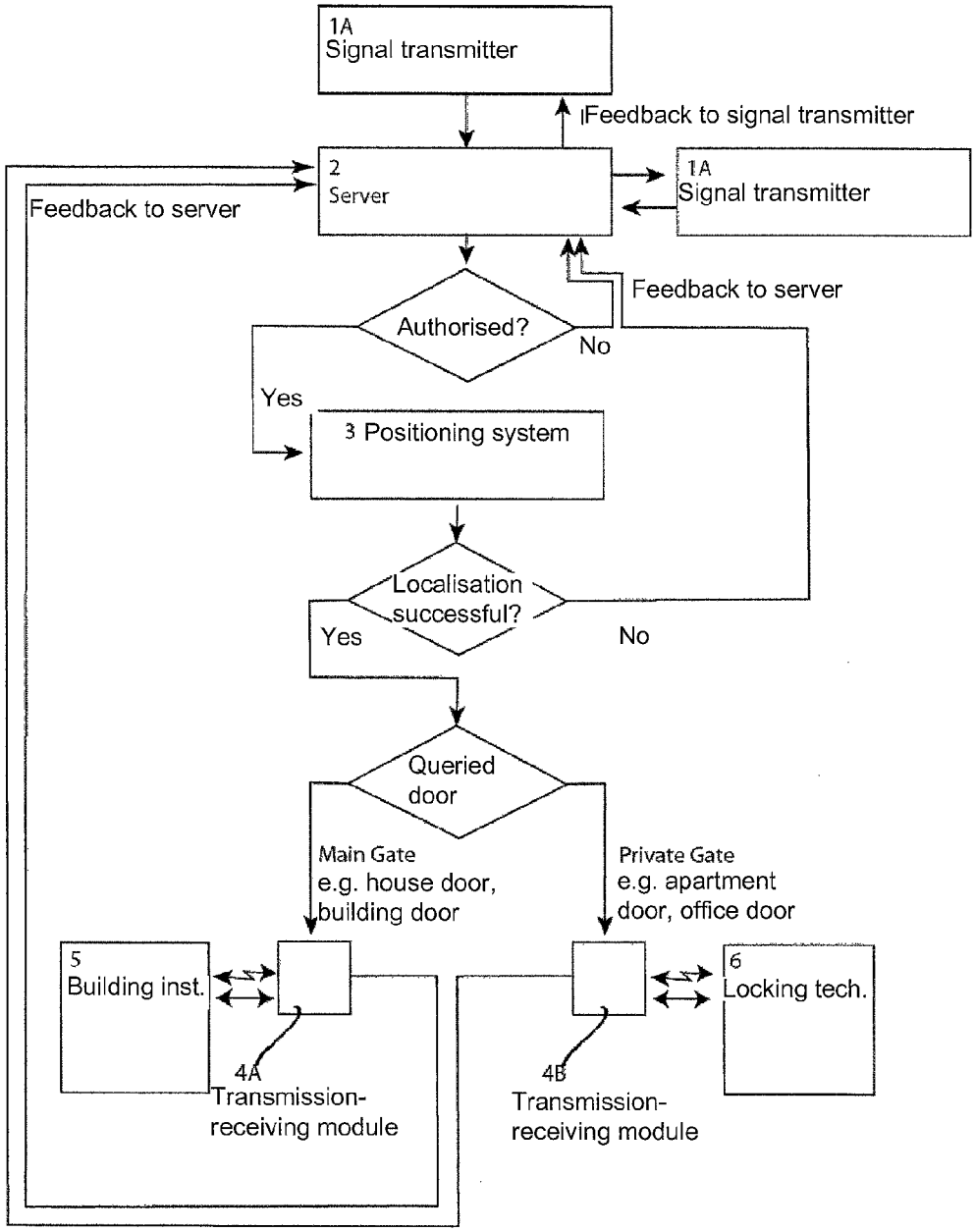
FIG. 6 shows a schematic flow chart of the utilisation process being carried out on the arrangement.

FIG. 6 shows a schematic flowchart of an exemplary utilisation process. A query to the server 2 occurs in a first step by one or several terminals, i.e. signal transmitters 1 of a user, e.g. his/her smart phone, tablet PC or notebook. The query from the terminal can alternatively also be transmitted to the position determination and identification system. In such a case, the determination of the location of the terminal and thus the user also occurs simultaneously.

The server carries out a query routine after the authorisation of the user and sends a response to the terminal on the result of the authorisation process. In the event of a positive result of the authorisation, the server also outputs a respective signal to one or several base stations 3A and/or 3B situated within the building. If both base stations are activated, a triangulation of the signal transmitter is performed and the location of the user is thus detected. An unsuccessful triangulation is reported back to the server and output of the signal transmitter of the user. The location of the user could not be recognised in this case.

In the case of successful localisation, a test is performed on whether the current location of the user or its signal transmitter corresponds to the access to the building which is to be opened. If this is the case, the respective control units are supplied with a signal and switch the respective locking mechanisms of the respective access, so that the respective access points can be unlocked and the user can enter.

The localisation can also be used to unlock precisely the one access for a user with general access rights in front of which he or she is currently located, whereas all other access points in the area of the building remained closed. It can thus be prevented that an unlimited access right of a user leads to the consequence that unauthorised persons can simultaneously enter the building area via other access points.

It is advantageous if by means of the localisation continuing tracing of the location of the signal transmitter of the user occurs, so that the access points in his/her path can be unlocked and locked again behind said user, for which he or she has access authorisation. Each of these localisation processes are reported back to the server and indicated on the terminal of the user as feedback.

Similarly, the successful or unsuccessful locking processes which were carried out at the respective access points are reported back by the respective control units to the server and output as feedback to the signal transmitters of the user. The user is thus informed in any case on whether a locking process was performed and the result with which this has occurred. Furthermore, logging of the entire process occurs in the server, so that the status of each access and the involved users can be traced at all times.

Figure 7:
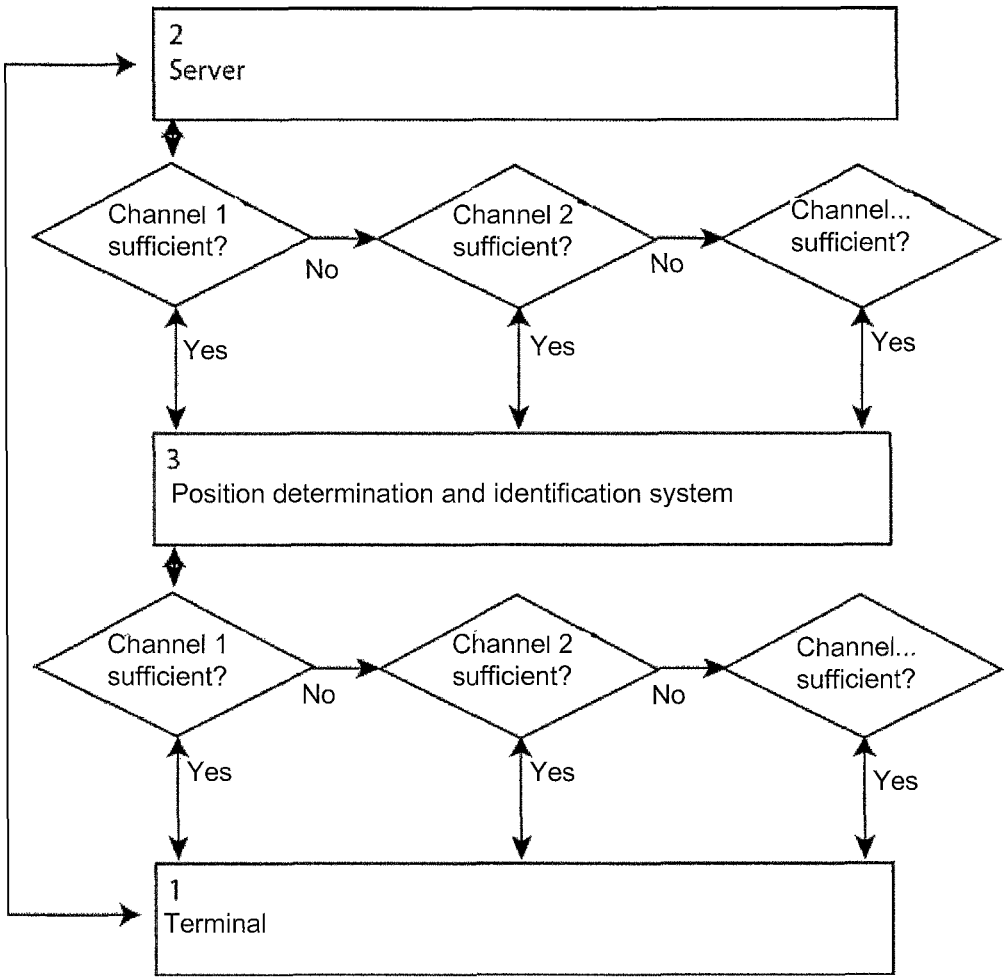
FIG. 7 shows a schematic flow chart of an alternative channel transmission system between the server, the positioning system and the terminal.

FIG. 7 shows a schematic flowchart of a multiple channel transmission system between the server 2 and the base station 3 in the building area. A respective flowchart is also principally possible between the terminal 1 of the user and server 2 as well as between the server 2 and the control unit.

After the completed authentication, authorisation and optional localisation, the server 2 initiates a connection to the base station 3 of the mentioned access system, as already explained above. In order to improve security of the connection against failure, there are several possible communications channels. The actually used communications channel is mainly selected according to current availability and economical aspects. If the first selected channel is not available, switching is performed to the next channel. It can be more expensive from an economic standpoint and more unfavourable from the aspect of transmission technology. If local internet is temporarily off-line, communication then occurs via GPRS, i.e. via a mobile radio network. The communications connections can concern GPRS, EDGE, UMTS, LTE, WLAN, WiMAX, femtocells, satellite access, cable-bound internet and/or a phone connection, via which the opening signal is transmitted by the server for the respective door and the respective feedback is transmitted back to the server.

The security is advantageously ensured in each of the used channels via encryption methods such as "pre-shared keys" or SSL. For the purpose of preventing misuse, the data transmitted to the personal hardware platform are protected in a wallet by an individual password.

Figure 8:
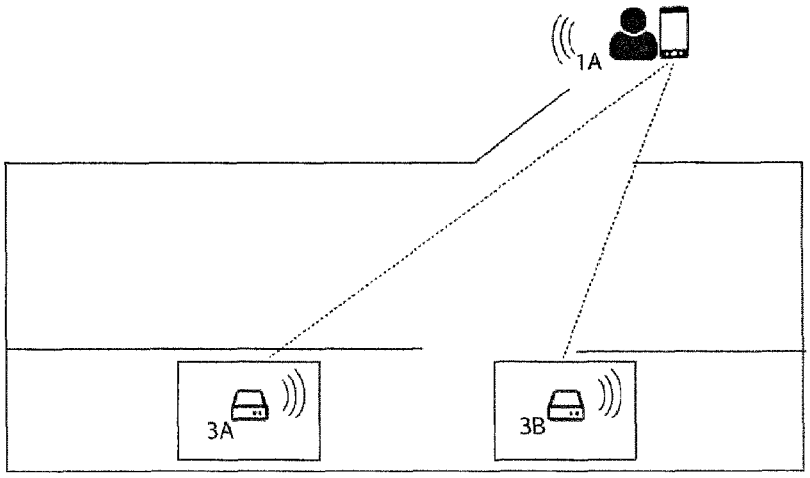
FIG. 8 shows a schematic triangulation by means of two gateways for localising a personal hardware platform or a terminal.

FIG. 8 shows a schematic triangulation by means of two gateways for localising a personal hardware platform or a terminal. Triangulation occurs by the measurement of the strength of the incoming signal of the terminal of the user by the two base stations 3A and 3B. The distances between the base station 3A from the terminal and between the base station 3B from the terminal can be detected by the ratio of the signals detected by the two base stations 3A and 3B. The distance between the base stations is known, so that the position of the terminal can occur unequivocably via the determination of the points of intersection of two circles. This is the basis of triangulation. The presence of the terminal user in front of the door can be checked via the localisation signal of the terminal. This can be combined with an automated recognition of the entrance and exit of the terminal user.

Figure 9:
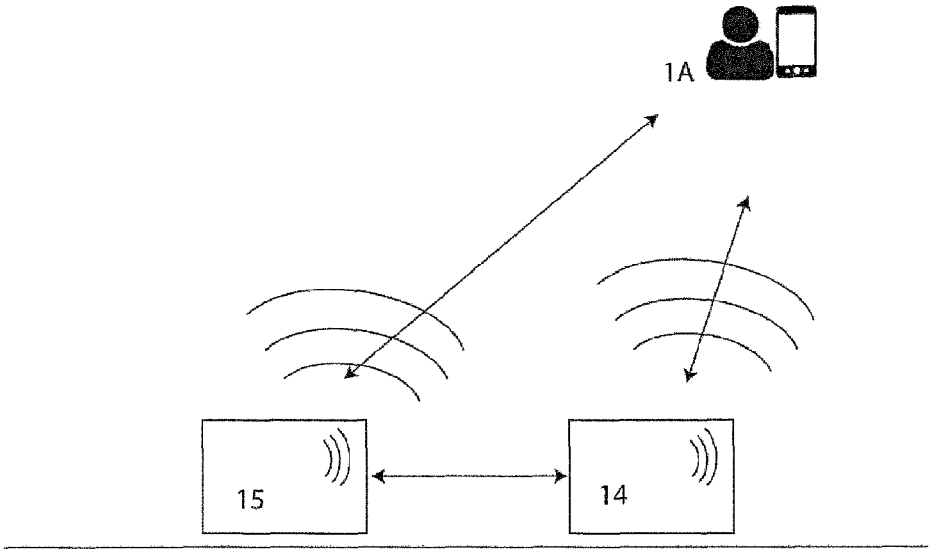
FIG. 9 shows a coupling of a motion detector on a local wireless transmitter for authorisation synchronisation with the central server.

In combination thereto or also as an alternative, a local radio sensor such as a motion detector 14 can be provided as shown in FIG. 9, which motion detector is coupled to a local radio transmitter 15. The local radio transmitter transmits information to the terminal once a movement and/or a signal of the platform triggers the motion detector. This includes automated verification of the information together with the user information and optional automated access to the structural element. In such a case, the user identifies himself/herself via the terminal directly on the server or directly on the base stations arranged within the building, wherein they will transfer the respective data to the server for authentication.

In another further development, FIG. 9 shows at least one local radio transmitter 15 and/or receiver 14, which transmits information to the terminal or receives information therefrom, so that this information can be used as position recognition in combination with authentication via the first or second communications channel.

Figure 10:
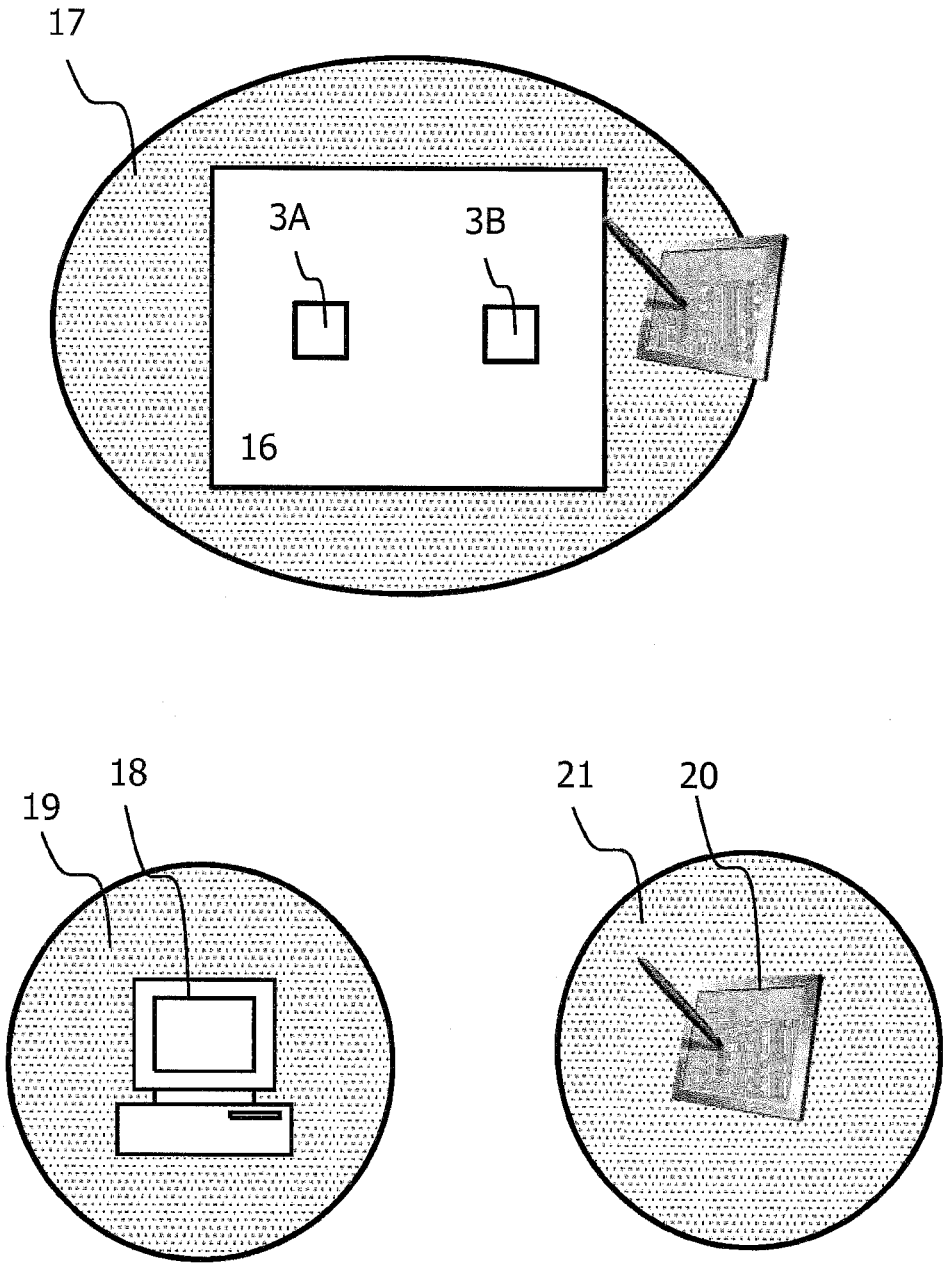
FIG. 10 shows an exemplary schematic configuration, in which in addition to triangulation the data of a position determination system, especially the GPS system, is also used for determining the location of the respective user terminals.

FIG. 10 shows an exemplary schematic configuration, in which in addition to triangulation the data of a position determination system, especially the GPS system, is also used for determining the location of the respective user terminals. The drawing shows a building 16 with base stations 3A and 3B arranged therein. They define a triangulation area 17, within which the locations of each user terminal can be determined by means of the described triangulation. So-called access points or access areas are additionally provided in the illustrated example. They comprise spatially predefined areas from which structural elements can be accessed in an authorised manner within the building from the outside.

The access areas can be defined in different ways. If the user terminal is formed as a stationary PC 18 for example which is connected to the long-range network via a network node with a defined location, the access point is defined for the PC as a network node location 19 or an IP address. Localisation within a specific radio cell can be used for mobile terminals 20. The access point for which access is permissible to structural elements within the building is then designated by defined radio cell information and forms a radio cell location 21.

Respective information is transmitted for this purpose by the components of the long-range network to the server or is additionally queried by the server and synchronised with the location data defined and authorised there. The thus defined access points or access areas need not necessarily be located in direct vicinity to the building. Their position can be located at any distance from the building and can be freely selected depending on the logistic requirements. As a result, maintenance services which are located at specific locations can be granted specific access to apparatuses of the building installations if it is ensured that these access queries occur from precisely defined operating locations.

Abstract definitions of the respective access points or access areas which have nothing to do with a real spatial arrangement are also possible. Such definitions can be made for example on the basis of specific area codes, predefined hierarchies of specific terminals, or existing architectures of subnetworks from different terminals or graduated access rights.

The arrangement in accordance with the invention was explained by reference to exemplary embodiments. Further embodiments arise from the dependent claims and from actions carried out by the person skilled in the art.

LIST OF REFERENCE NUMERALS

V1 Entire arrangement
1 Signal transmitter and/or receiver, terminal
1A First terminal
1B Second terminal
1C Third terminal
2 Server
3 Position determination and identification system
3A First position determination and identification system
3B Second position determination and identification system
3C Third position determination and identification system
4 Control unit
4.1 Transmission/receiving module

4.2 Power supply
4.3 Processor
4.4 Connection
4A First control unit
4B Second control unit
4C Third control unit
4D Fourth control unit
5 Building installations, especially intercom and locking system
5*a* Door opening button/switching relay
6 Locking mechanism
7 Door
7B Locking relay, door buzzer
8 Latch
9 Connecting cable
10 Circuit board
11 Switching module
13 Feed line
14 Motion detector
15 Local radio transmitter and/or sensor
16 Building
17 Triangulation area
18 Stationary PC
19 Network node location
20 Mobile terminal
21 Radio cell location
22 Data connection

The invention claimed is:

1. An arrangement for the authorised access of at least one structural element (5, 6, 7) located in a building, comprising a remote server (2) which is arranged in a long-range network for assigning and storing personalised access authorisation in connection, via a bidirectional communications channel, with a control unit (4, 4A, 4B, 4C, 4D) located in the building for the at least one structural element (5, 6, 7), and a position determination and identification system (3A, 3B) for a terminal (1, 1A, 1B), wherein as a result of an identifying location determination of the terminal (1) carried out by the position determination and identification system, a query can be made by the position determination and identification system (3A, 3B) via a bidirectional communications channel to the server for the access authorisation which is stored in said server and linked to the terminal, and an actuating action of the at least one structural element (5, 6, 7) can be carried out by the control unit (4) as a consequence of said query, wherein location data for indicating predefined access points or access areas can be predetermined for the position determination and identification system, wherein the location data are additionally freely selectable and definable in an abstract manner irrespective of the spatial position with respect to the building, wherein the definitions of the access points or access areas can be carried out with predefined hierarchies of specific terminals, existing architectures of subnetworks of different terminals and/or graduated access rights and the access authorisations linked to the access points can be transferred and/or exchanged via a direct bidirectional communication between the terminals.

2. An arrangement according to claim 1, characterized in that the bidirectional communications channel is automatically selectable or can be used in combination on the basis of current availability, precision and/or current cost factor.

3. An arrangement according to claim 1, characterized in that the respective access authorisation stored on the server (2) comprises positional data which are defined for each terminal and are unequivocably assigned to the respective terminal (1), wherein a spatially precisely defined access area can be determined by the positional data.

4. An arrangement according to claim 1, characterized in that the position determination and identification system (3) is formed by direct localisation determination by the server (2) and/or by means of at least one signal strength detector (3A, 3B) for the identification signal emitted by the terminal (1).

5. An arrangement according to claim 4, characterized in that the at least one signal strength detector is respectively formed as a near-field sensor and/or a near-field transmitter.

6. An arrangement according to claim 1, characterized in that the position determination and identification system comprises at least one near-field transmitter (15) for signal exchange with the terminal (1), wherein the data transmitted via the signal exchange are provided for data synchronisation with access data stored on the server (2).

7. An arrangement according to claim 1, characterized in that the position determination and identification system can be activated following a message emitted by the terminal (1), a utilisation documentation of the terminal, and/or a change in the access authorisation.

8. An arrangement according to claim 1, characterized in that the control unit (4) is formed as a virtual door opener that can be operated remotely, wherein the at least one structural element is formed as at least one locking, closing and/or securing device which can be actuated by the control unit.

9. An arrangement according to claim 8, characterized in that the virtual door control unit is formed for access to and/or communication with an in-house building installation system and/or access system installation (5) as the structural element, with which a locking, closing, securing and/or control device can be switched and controlled, in that the signals are exchangeable with the server.

10. A method for the authorised access of at least one structural element (5, 6, 7) located in a building, characterized in that as a result of an identifying location determination of a terminal (1) carried out by the position determination and identification system (3, 3A, 3B), a query is made by a control unit (4) via a first bidirectional communications channel to a server for the access authorisation which is stored in said server and linked to the terminal, and an actuating action of the at least one structural element (5, 6, 7) is carried out by the control unit (4) as a consequence of said query, wherein location data for indicating predefined access points or access areas can be predetermined in advance for the position determination and identification system, wherein the location data are additionally freely selectable and definable in an abstract manner irrespective of the spatial position with respect to the building, and the definitions of the access points or access areas can be carried out with predefined hierarchies of specific terminals, existing architectures of subnetworks of different terminals and/or graduated access rights.

11. A method according to claim 10, characterized in that a bidirectional data transmission is carried out between several personal terminals, in which an access authorisation assigned to a first terminal 1A is transferred to a second terminal 1B, wherein now the terminal 1B can act as a carrier of access authorisation, wherein the thus occurring transfer of the access authorisation is controlled by a number of administration levels.

* * * * *